United States Patent [19]

Madsen

[11] Patent Number: 5,035,165

[45] Date of Patent: Jul. 30, 1991

[54] QUICK SLIP HOLDER FOR BAG MACHINE

[76] Inventor: Dale R. Madsen, 2392 Taylor Rd., Savannah, N.Y. 13146

[21] Appl. No.: 529,646

[22] Filed: May 29, 1990

[51] Int. Cl.[5] ..... B26F 1/02; B26F 1/18

[52] U.S. Cl. ..... 83/618; 83/698; 83/699; 493/366; 493/372

[58] Field of Search ..... 83/618, 620, 698, 699, 83/700, 697; 493/195, 238, 363, 366, 372; 403/381, 341, 391, 385

[56] References Cited

U.S. PATENT DOCUMENTS

| | | | |
|---|---|---|---|
| 500,153 | 6/1893 | Parman | 403/341 X |
| 1,918,843 | 7/1933 | Holmes | 403/385 |
| 2,626,667 | 1/1953 | Spiller | 279/41 |
| 3,196,728 | 7/1965 | Snow | 83/618 |
| 3,368,441 | 2/1968 | Piazze | 493/372 X |
| 3,802,308 | 4/1974 | Davis, Jr. | 83/99 |
| 3,973,453 | 8/1976 | Tameo | 83/620 X |
| 4,106,181 | 8/1978 | Mattchen | 83/698 X |
| 4,176,567 | 12/1979 | Weisberg | 83/697 X |

*Primary Examiner*—Frank T. Yost
*Assistant Examiner*—Eugenia A. Jones
*Attorney, Agent, or Firm*—Shlesinger Fitzsimmons Shlesinger

[57] ABSTRACT

A clamp member has a pair of integral jaws defining an aperture in which the upper end of a punch adaptor is clamped when the jaws are forced closed. The adaptor has a punch fastened to its lower end, for example by a tongue and groove connection; and a slitter blade is releasably attached to the clamp member adjacent the flexible jaws. The upper end of the punch adaptor is tubular and has therein axially extending slots forming radially compressible sectors which can be forced into gripping engagement with an operating shaft when the jaws on the clamp member are forced closed over the punch adaptor.

14 Claims, 3 Drawing Sheets

QUICK SLIP HOLDER FOR BAG MACHINE

BACKGROUND OF THE INVENTION

This invention relates to machines for making plastic bags, and more particularly to an improved bag punching and slitting device for such machines. Even more particularly, this invention relates to improved means for releasably mounting bag punching and slitting devices on such machines.

There are presently available a number of machines which are employed for manufacturing plastic bags out of thermoplastic materials. One such machine is disclosed in the U.S. Pat. No. 3,802,308, which was granted Apr. 9, 1974. In a machine of this type, overlapping webs of a thermoplastic material are passed beneath a so-called punching and slitting device, which reciprocates toward and away from the overlapping plastic webs in order simultaneously to form adjacent slits and perforations in what is to be the open end of a respective bag. Typically each such punching and slitting device comprises a punching element having a circular, generally serrated edge, and a cutting blade which is mounted in the device in spaced, adjacent relation to the punch.

In the above-noted U.S. Pat. No. 3,802,308, for example, a pair of such punches and their associated cutting blades are secured in a conventional manner by screws or bolts to a plate 92. Plate 92 is fastened, also in a conventional manner, to the piston of an air cylinder, so that the plate and the attached punches and cutter blades can be reciprocated toward and away from the plastic bags. Similarly, U.S. Pat. No. 3,196,728 discloses a cutting blade and punch that are mounted side by side on a plate which is attached to the lower end of a piston, that is operable to reciprocate the plate, and hence the attached punch and slitter blade, toward and away from a bag of transparent plastic material, thereby simultaneously to punch and slit the bag. Again, however, the punch and blade are mounted on the reciprocable support plate in a very conventional manner, and the support plate in turn is fastened to the piston shaft by conventional threaded fittings.

A major problem with existing mounting devices for punches and slitter blades of the type described is that, whenever it is necessary to change a punch and/or slitter blade, or to change or remove the punch and blade holder device, it is necessary to shut down the associated bag making machine. These changes therefore can be very time consuming and expensive to effect, and often require the use of skilled labor.

It is an object of this invention, therefore, to provide improved means for mounting bag punching and slitting devices in bag making machines of the type described.

Another object of this invention is to provide improved mounting means of the type described which enables a bag punching and slitting device to be installed in or removed from a bag making machine of the type described extremely rapidly and by use of a simple tool.

More particularly, it is an object of this invention to provide a novel quick slip holder, which can be quickly and easily operated by an unskilled operator to effect a rapid change and/or adjustment of punches and slitting blades of the type described.

Other objects of the invention will be apparent hereinafter from the specification, and from the recital of the appended claims, particularly when read in conjunction with the accompanying drawings.

SUMMARY OF THE INVENTION

The device comprises a clamp member having a pair of integral jaws defining therebetween an aperture for clamping therein the upper end of a punch adaptor, when the jaws are forced closed. The adaptor has a punch fastened to its lower end to project beneath the clamp member; and a slitter blade is releasably attached to the clamp member adjacent the flexible jaws, and projects beneath the clamp member adjacent the punch. The upper end of the punch adaptor is tubular, so that it can be inserted over the lower end of the reciprocable operating shaft of an air cylinder or the like, and has therein axially extending slots forming on the adaptor radially compressible sectors which can be forced into gripping engagement with the shaft when the jaws on the clamp member are forced closed.

The punch can be releasably attached to the lower end of the adaptor by a tongue and groove connection; and the slitter blade is releasably secured at its upper end between a clamping surface on the clamp member, and a pressure plate, which is adjustably mounted along one edge on the clamp member to overlie the clamping surface on the clamp member. The pressure plate is urged toward the clamping surface by a pivotal camming member or by a screw and nut connection.

THE DRAWINGS

DETAILED DESCRIPTION OF THE PREFERRED EMBODIMENTS

Figure 1:
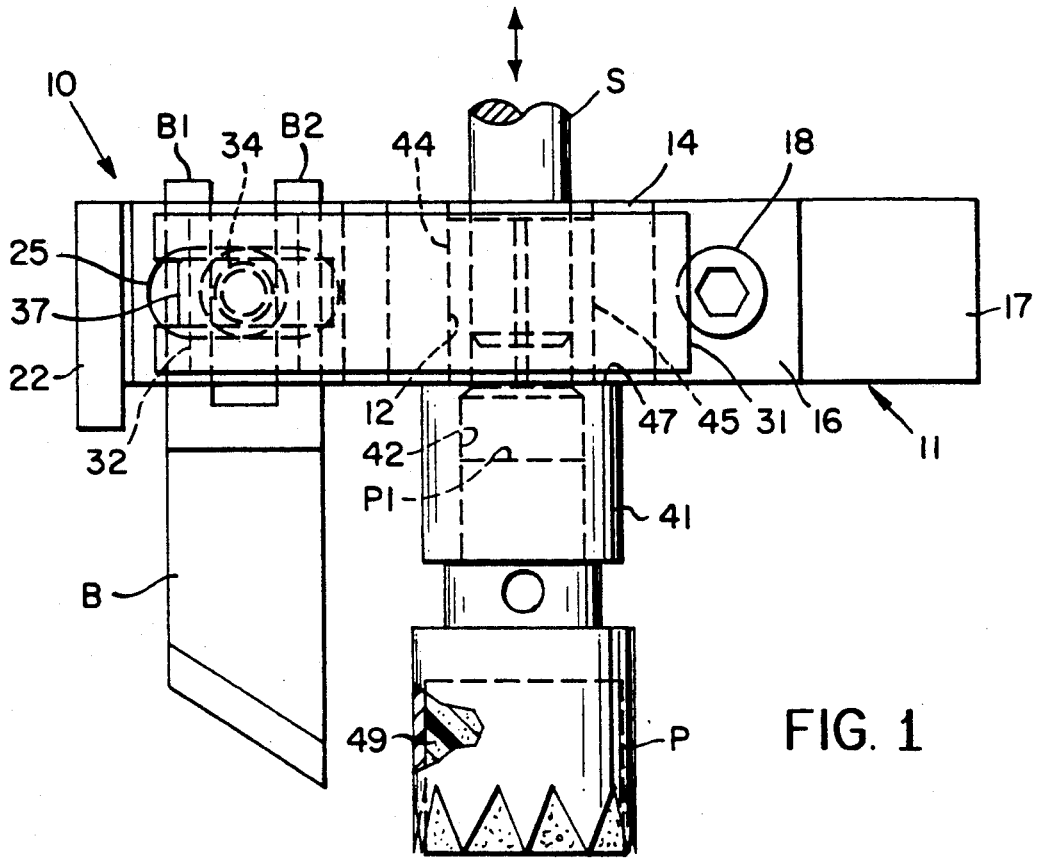
FIG. 1 is a fragmentary side elevational view of an improved holder device for a bag punch and slitter blade made according to one embodiment of this invention, portions of the associated punch being broken away and shown in section.
Figure 2:
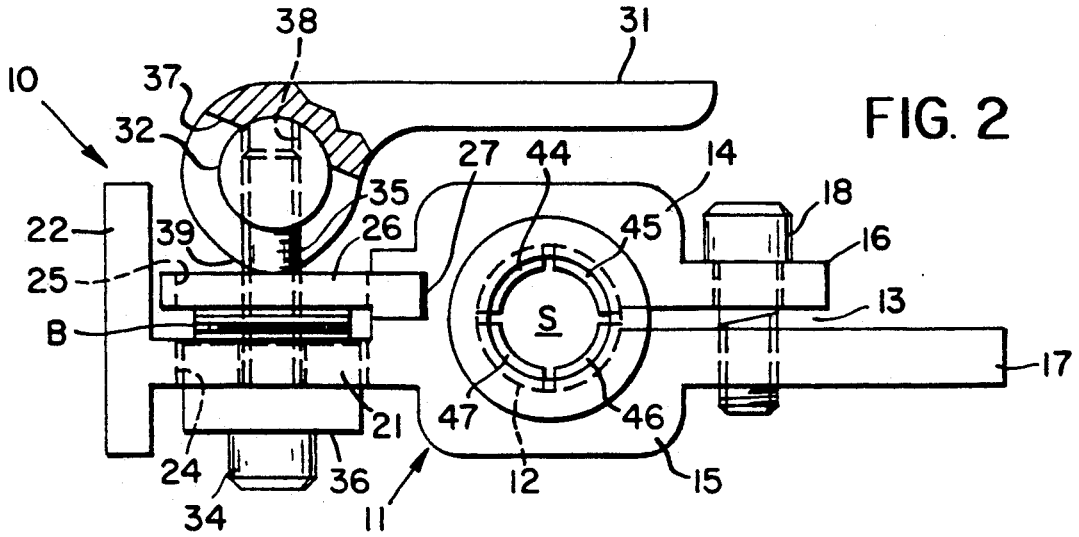
FIG. 2 is a bottom plan view of this device, but with the punch removed, and with a portion of the blade holder section of the device being broken away and shown in section.

Referring now to the drawings by numerals of reference, and first to the embodiment shown in FIGS. 1 and 2, 10 denotes generally a novel holder device for a punch P and a slitter blade B of the type which are employed in conventional bag making machines for the purpose of being reciprocated toward and away from the bag which is to be punched and slit by the shaft S of an air cylinder or the like (not illustrated). Device 10 includes a one-piece aluminum or plastic clamp, which is denoted generally by the numeral 11, and which has therethrough a circular opening 12. Opening 12 communicates at one diametral side thereof with a slot 13, which is formed in the right end (FIGS. 1 and 2) of clamp 11 to lie in a plane containing the axis of the opening 12. Slot 13 thus divides the right end of clamp 11 into two flexible jaws 14 and 15, which are integral at their inner ends with the clamp 11, and which have spaced outer ends 16 and 17, respectively, that are adjustably connected together by a screw 18.

Remote from and extending parallel to its free end 17, the jaw 15 of clamp 11 has projecting from its closed end an integral, slotted clamping leg 21. Integral with the outer or left end of leg 21, and extending at a right angle thereto, is a rectangular projection 22, which can be used for purposes of guiding the device 10 when it is reciprocated. Intermediate its ends the leg 21 of clamp 11 has therein an elongate slot 24, which registers with a similarly shaped slot 25 that is formed in a removable, generally rectangularly shaped clamping or pressure plate 26. Plate 26 is removably and slidably seated along one edge thereof in a rectangular notch or slot 27, which is formed in the closed end of the jaw 14 remote from its free end 16. Plate 26 thus extends in spaced, parallel relation to the clamping leg 21 between the notch 27 and the inner surface of the projection 22 on leg 21.

As shown more clearly in FIG. 1, the blade B has in its upper end an elongate, rectangular slot, which divides the upper end of the blade into two, spaced, parallel legs B1 and B2. These two legs are clamped in the space between the clamping leg 21 and the clamping plate 26 by a pivotal clamping member 31, which is mounted at one end thereof (the left end in FIGS. 1 and 2) to pivot about a stationary pivot pin 32, the axis of which extends parallel to the axis of the opening 12 in clamp 11. Pin 32 is secured to clamp 11 by a screw 34 having an externally threaded, reduced-diameter shank portion 35 that extends from the head of the screw successively through an enlarged-diameter opening in a washer 36, which is interposed between the head of this screw and the clamping leg 21, through the slot 24 in leg 21, through the space between the legs B1 and B2 of the blade B, through the slot 25 in the clamping plate 26, through an arcuate slot 37 formed in the pivotally mounted end of clamping member 31, and into an internally threaded, diametral bore 38 in pin 32. The pivotal end of the clamping member 31 has formed on the outer surface thereof a curved camming surface or lobe 39, which is designed to engage and urge the clamping plate 26 toward the clamping leg 21, when the clamping member 31 has been swung clockwise about the axis of pin 32 into its clamping position as shown in FIG. 2. In this position the legs B1 and B2 of the blade B will be clamped firmly between the confronting surfaces of the clamping plate 26 and the clamping leg 21.

In order to release the blade B from clamp 11, one need only to swing the clamping member 31 manually counterclockwise about the axis of pin 32, as shown in FIG. 2, whereby its camming surface will be swung also in a counterclockwise direction to remove the camming lobe 39 from clamping engagement with plate 26. This, in effect, will release the plate 26 from clamping engagement with the blade B, so that the latter can be slipped downwardly (FIG. 1) and out of the clamp 11.

Referring to FIG. 1, 41 denotes a tubular adaptor, which is employed for removably mounting the punch P in clamp 11. Punch P has at its upper end a reduced-diameter section P1, which is press fit or otherwise fixed in the lower end of an axial bore 42 in adaptor 41. The adaptor 41 has a reduced-diameter upper end containing four equi-angularly spaced, longitudinally extending slots, which divide the upper end of adaptor 41 into four, arcuate, equi-angularly spaced sectors 44, 45, 46 and 47 (FIG. 2). Intermediate its ends adaptor 41 has formed thereon a circumferential shoulder 47, which is removably seated against the underside of clamp 11 (FIG. 1) when the adaptor is fully seated in the opening 12 formed by the clamping jaws 14, 15.

In use, clamping member 31 is swung counterclockwise from its position as shown in FIG. 2 in order to permit the insertion of a blade B into, or the removal of the blade B from, the clamp 11. Assuming that the blade B has been inserted into the position as shown in FIGS. 1 and 2, the clamping member 31 is then swung clockwise about the axis of pin 32 back to its clamping position as shown in FIG. 2. Obviously the height of the cutting edge of the blade B relative to the clamp 11 can be adjusted by virtue of the slotted upper end of the blade. Similarly, adjustment of the blade B laterally relative to the clamp 11 can be made, when the clamping member 31 is in its released position, by virtue of the elongate slots 24 and 25 provided in the clamping leg 21 and clamping plate 26, respectively.

Also, in order to insert an adaptor 41 with the attached punch P, into the clamp 11, or to remove it from the clamp 11, the screw 18 can be adjusted to permit the ends 16 and 17 of the jaws 14 and 15 to separate slightly relative to the position as shown in FIG. 2, thereby increasing the overall diameter of opening 12, and thereby providing enough room for inserting the upper end of the adaptor 41 into, or for withdrawing it from, the opening 12. Assuming that the adaptor 41 has been inserted into clamp 11, the entire device 10 can then be removably and rapidly mounted on the shaft S of an air cylinder in a bagging machine, or the like, simply by inserting the slotted, upper end of the adaptor 41 onto and around the outside of the lower end of the shaft S, as shown for example in FIG. 1. Thereafter the screw 18 can be tightened, and will thus cause the jaws 14 and 15 securely to clamp around the outside of the upper end of the adaptor 41, thereby causing its four, arcuate, radially compressible segments 44–47 securely to grip the lower end of the shaft S. In this manner the entire device 10, together with the attached blade B and punch P, can be rapidly and readily secured in, or removed from, a conventional bag making machine of the type described.

As shown in FIG. 1, the punch P is adapted to have a resilient, plastic core 49 releasably secured in a bore in the lower end of the punch in order to disengage a piece of plastic from the punch P after the latter has been employed for punching a hole in the plastic.

Figure 3:
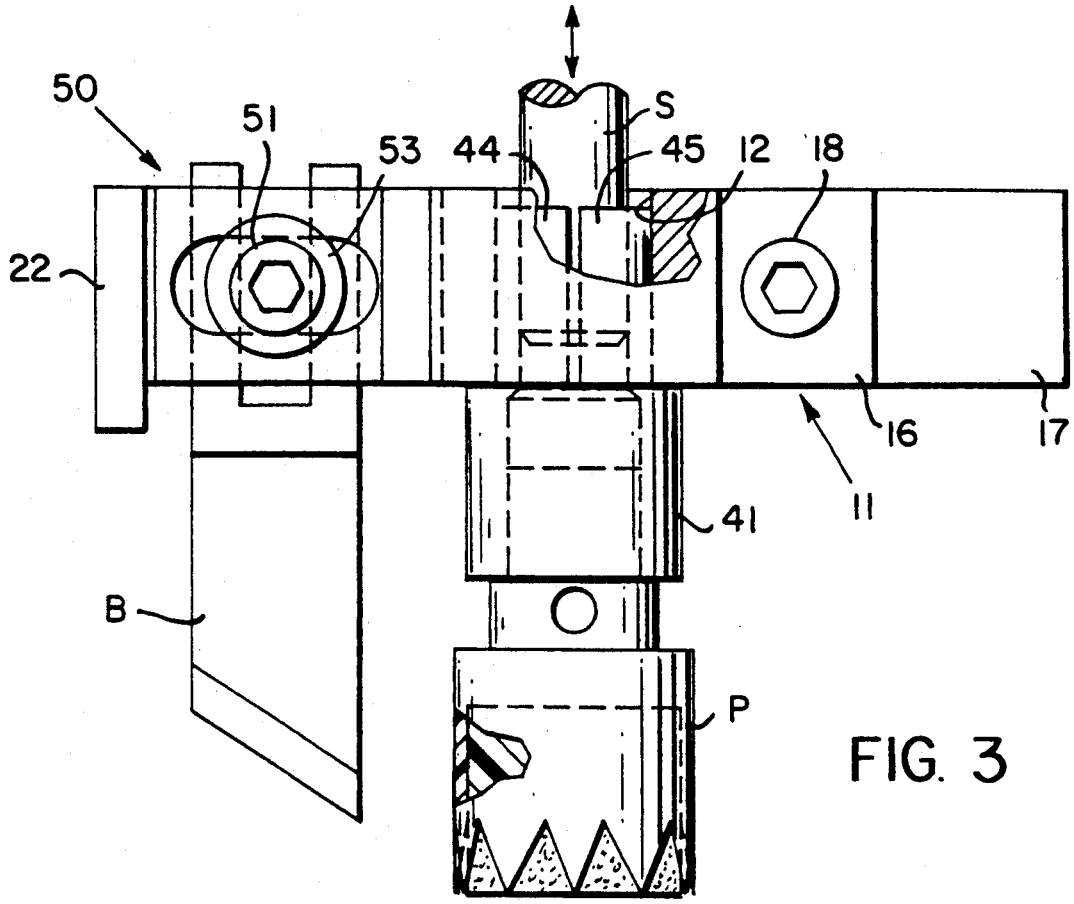
FIG. 3 is a fragmentary side elevational view of a second embodiment of this device showing a modification of the blade holder section thereof, portions of the device again being broken away and shown in section.
Figure 4:
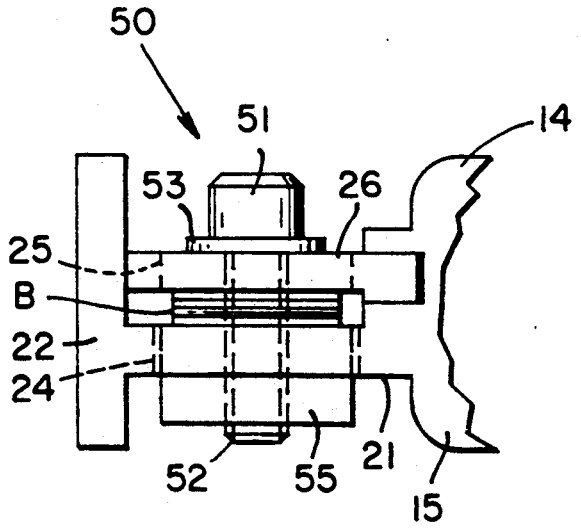
FIG. 4 is a fragmentary, bottom plan view of the blade holder section of this second embodiment.

Referring now to the embodiment shown in FIGS. 3 and 4, wherein like numerals are employed to denote elements similar to those illustrated in the first embodiment, 50 denotes generally a modified holder device in which the pivotal clamping member 31 has been replaced by a screw 51 having an externally threaded shank 52, which passes through a washer 53, which is interposed between the head of screw 51 and the clamping plate 26, and then successively through the slot 25 in plate 26, the space between the two legs B1 and B2 on the upper end of the blade B, and through the slot 24 in the clamping leg 21, after which its terminal end is threaded into a nut 55 that is threaded onto screw 51 at the outside of the clamping leg 21. By way of example, the head of screw 51 may be of the type which is adapted to be manipulated by an Allen wrench, as is the head of the screw 18, which connects together the jaws 14 and 15 of the associated punch holding section of the clamp 11. Thus, with a single tool (an Allen wrench), it is possible releasably to mount the holding device 50 on the lower end of the reciprocable operating shaft S, as well as being able selectively to replace the punch P and the blade B.

Figure 5:
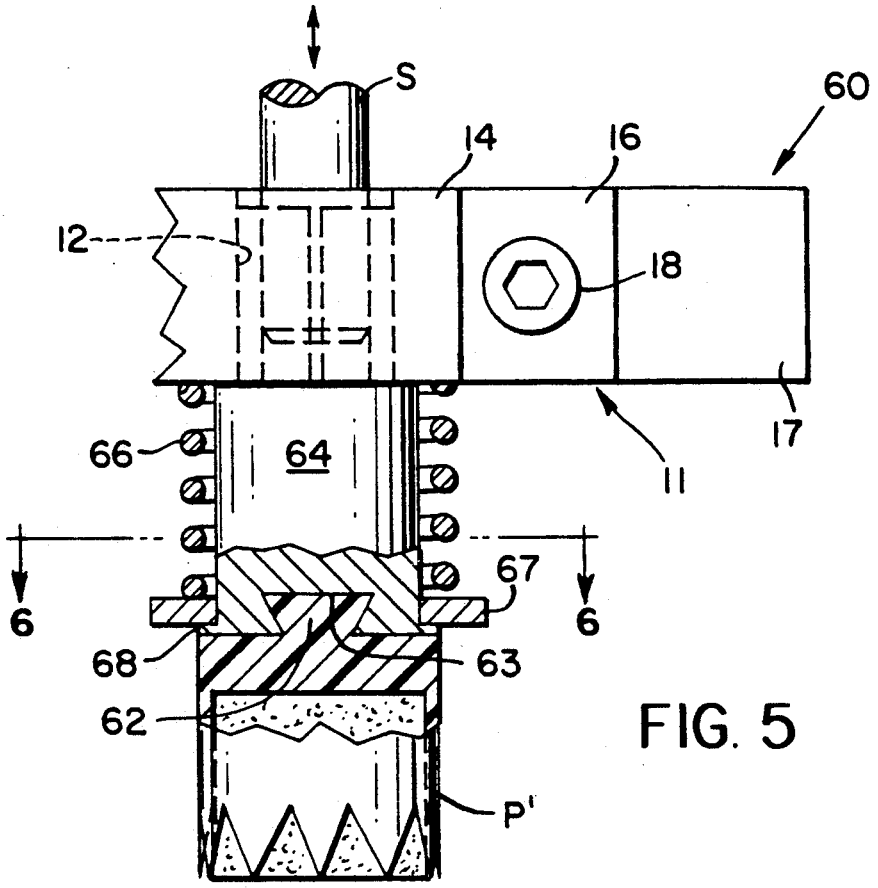
FIG. 5 is a fragmentary side elevational view of a third embodiment of this invention illustrating a modified form of the punch holder section of the device, portions of the holder section and associated punch being broken away and shown in section.
Figure 6:
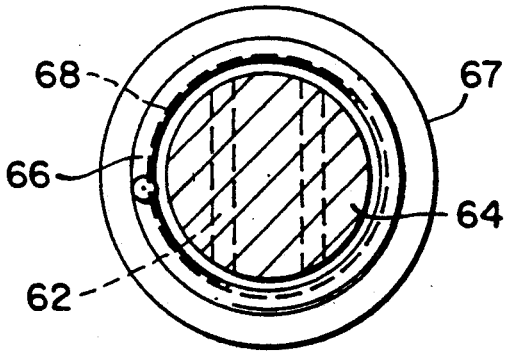
FIG. 6 is a sectional view taken generally along the line 6—6 in FIG. 5 looking in the direction of the arrows.

Referring now to the embodiment shown in FIGS. 5 and 6, where like numerals again are employed to denote elements similar to those employed in the preceding embodiments, 60 denotes generally still another form of this holding device, which includes a modification of the punch mounting means therefor. For example, although clamp 11 may be of the same construction, the punch P' in this embodiment has integral with its upper end a dovetail shaped tongue or key 62, which projects upwardly from and extends transversely across a plane surface formed on the upper end of the punch P'. Key 62 is disposed to be positioned slidably and releasably in a correspondingly shaped dovetail groove or way 63 that is formed transversely across the cylindrically shaped lower end of a modified adaptor 64. As in the case of the adaptor 41, the modified adaptor 64 has a reduced-diameter, slotted upper end which is adapted to be releasably secured in the clamp member 11 between the jaws 14 and 15 and shaft S in the same manner as the upper end of the adaptor 41.

However, unlike adaptor 41, the lower end of adaptor 64—i.e., the end thereof which extends beneath the clamp 11, is surrounded by a coiled compression spring 66, which is seated at its upper end against the underside of clamp 11, and at its lower end against the upper surface of an annular ring or collar 67, which surrounds and is axially slidable on adaptor 64. The underside of the collar or ring 67 normally is seated upon the upper surface of an external, circumferential flange 68, which is integral with and surrounds the lower end of adaptor 64. Normally the ring 67 is held resiliently by spring 66 in the position shown in FIG. 5, wherein it surrounds opposite ends of the groove or way 63 in adaptor 64, and opposite ends of the key 62, so that it is not possible to remove the key 62 from the way 63.

However, if one wishes to remove the punch P', one need only to elevate ring 67 on the adaptor 64 against the resistance of spring 66, and far enough to expose opposite ends of the way 63, at which time the key 62 can be shifted radially out of the slot or way 63 to disengage the punch P' from the adaptor 64. This, notably, can be performed without the use of any tools, and with a minimum of down-time of the associated bag making machine.

From the foregoing it will be apparent that the present invention provides a novel and relatively simple punch and blade holding device for bag making machines of the type described, and which device can be rapidly and simply attached to an associated operating shaft S simply by slightly opening and closing the jaws 14 and 15 of clamp 11. Likewise, the associated punch P or P' and blade B can be readily and releasably attached to the clamp 11 with or without tools. That is, FIGS. 1 and 2 disclose a manually operable clamping member 31, which can be operated for releasably attaching a Blade B to a holding device 10 without the use of a tool; while the embodiments shown in FIGS. 5 and 6 illustrate a manner in which a punch P' can be releasably attached to clamp 11 also without use of a tool, assuming that the adaptor 64 has been attached to the shaft S. It is anticipated, therefore, that the novel holder device as disclosed herein could incorporate in a single device any one of the various blade and punch mounting means disclosed above. For example, if desired, the punch mounting means as shown in FIGS. 5 and 6 could be utilized in place of the punch mounting means shown in FIGS. 1 and 2. In such case, of course, no tool at all would be required for replacing either the blade B or the punch P'. Moreover, each of the disclosed devices 10, 50 and 60 can be releasably and readily attached to the operating shaft S simply by manipulating the jaws 14 and 15 of the associated clamp 11.

Since the holder device in many cases may have to be reciprocated as much as 250 cycles per minute, it is desirable that the device be made from a tough but light material; and it is for that reason that it is preferred that clamp 11 and the associated clamping elements be made from aluminum or a light but sturdy plastic material. Moreover, the devices 10 and 50 are particularly suited for blades B and punches P made of plastic, while punch P' may be made of steel. Furthermore, although the invention has been illustrated and described in detail in connection with only certain embodiments thereof, it will be apparent that it is capable of still further modification, and that this application is intended to cover any such modifications as may fall within the scope of one skilled in the art or the appended claims.

I claim:

1. In a plastic bag making machine having a reciprocable operating shaft for moving a punch and a slitter blade toward and away from a plastic bag, a holder device, comprising a punch adaptor, a clamp member disposed to be attached to said operating shaft for reciprocation thereby, and having thereon a pair of integral, flexible jaws defining therebetween an aperture for releasably retaining therein one end of said punch adaptor, means for securing one end of a punch to the opposite end of said adaptor to be supported thereby on said clamp member so that the opposite end of said punch projects beneath said clamp member, means on said clamp member for securing one end of a slitting blade releasably to said clamp member adjacent said jaws, and in such manner that the opposite end of said blade projects beneath said clamp member adjacent said opposite end of said punch, and adjustable means for releasably urging said flexible jaws of said clamp member toward one another from a release position to a clamping position, when said one end of said adaptor is positioned in said aperture, thereby releasably to secure said one end of said adaptor in said clamp member.

2. In a machine as defined in claim 1, wherein said one end of said adaptor has therein, an axial bore that is insertable coaxially over one end of said reciprocable operating shaft, when said one end of said adaptor is in said aperture and said jaws are in their release position, and said one end of said adaptor is radially compressible into gripping engagement with said one end of said operating shaft when said jaws are moved to their clamping position, whereby said jaws are operable releasably to secure said punch to said clamp member, and releasably to secure said clamp member to said operating shaft.

3. In a machine as defined in claim 2, wherein said one end of said adaptor is tubular in configuration and has in the annular wall thereof a plurality of equi-angularly spaced, longitudinally extending slots operatively dividing said wall into a plurality of radially compressible sectors.

4. In a machine as defined in claim 1, wherein said means for securing said one end of a punch to said opposite end of said adaptor, comprises a tongue and groove connection for releasably connecting together a pair of confronting surfaces on said one end of said punch and said opposite end of said adaptor, respectively, said connection comprising a tongue shaped projection formed on one of said pair of surfaces and slidably seated in a correspondingly shaped groove formed in the other of said pair of surfaces.

5. In a machine as defined in claim 4, means for releasably retaining said tongue shaped projection seated in said groove, comprising a locking element mounted on one of the interconnected ends of said punch and said adaptor, respectively, for limited movement between a locking position in which said element blocks opposite ends of said groove to prevent withdrawal of said tongue shaped projection therefrom, and a release position in which opposite ends of said groove are exposed to permit withdrawal of said projection from said groove.

6. In a machine as defined in claim 5, including means normally urging said locking element resiliently into said locking position.

7. In a machine as defined in claim 1, wherein said means for securing one end of a slitting blade to said clamp member comprises, a clamping surface formed on said clamp member adjacent said jaws and disposed to engage one side of said one end of said slitting blade, a clamping plate adjustably mounted on said member and having thereon a clamping surface disposed to overlie said clamping surface on said member in spaced, generally parallel relation thereto, and disposed to engage the opposite side of said one end of said slitting blade, and manually operable clamping means connecting said clamping plate to said clamp member and operable selectively to force said clamping surfaces one toward the other thereby releasably to clamp said one end of said slitting blade therebetween.

8. In a machine as defined in claim 7, wherein said clamping means comprises a screw having a head on one end thereof and having a reduced diameter shank extending from said head through registering openings in said clamp member, said one end of said slitting blade, and said clamping plate, respectively, and a clamping element mounted on the end of said shank remote from said head and rotatable relative to said screw into and out of an operative position in which it effects the clamping of said one end of said blade between said clamping surfaces.

9. In a machine as defined in claim 8, wherein said clamping element is a nut threaded onto said shank coaxially thereof.

10. In a machine as defined in claim 8, wherein said clamping element is mounted adjacent one end thereof on said shank for pivotal movement about an axis transverse to the axis of said shank between blade clamping and release positions, respectively, and said clamping element has thereon a cam lobe movable toward and away from said clamping surfaces upon pivotal movement of said clamping element in opposite directions.

11. A device for releasably mounting a punch and a slitting blade on an operating shaft for reciprocation thereby in unison, comprising a clamp member having thereon a pair of clamping jaws, a punch adaptor projecting at one end between said jaws, means on said clamp member for adjustably urging said jaws toward one another thereby firmly to grip said one end of said adaptor releasably between said jaws, means for connecting one end of a punch to the opposite end of said adaptor to be supported thereby beneath said clamp member, and means on said clamp member for releasably securing one end of a slitting blade to said clamp member adjacent said jaws so that the opposite end of said blade is supported beneath said clamp member adjacent said punch, said one end of said adaptor being generally tubular in configuration so that it can be inserted coaxially over one end of said operating shaft thereby to surround said one end of said shaft, and being radially compressible so that when said jaws are urged toward one another to grip said one end of said adaptor, said one end of the adaptor is compressed radially inwardly to grip and secure the entire clamp member to said shaft for reciprocation thereby.

12. A device as defined in claim 11, wherein said means for securing one end of said slitting blade to said clamp member comprises a pressure plate adjustably mounted on said clamp member to engage said one end of said blade at one side thereof and to urge the opposite side of said blade against a clamping surface on said clamp member, and means for releasably urging said pressure plate toward said clamping surface thereby to grip said one end of said blade releasably between said pressure plate and said clamping surface.

13. A device as defined in claim 12 wherein said means for urging said pressure plate toward said clamping surface comprises a camming member engaging the side of said pressure plate remote from said clamping surface, and pivotally mounted on said clamp member selectively to apply pressure to said pressure plate.

14. A device as defined in claim 11, wherein said means for connecting said one end of said punch to said adaptor comprises a tongue and groove connection between said punch and said adaptor, respectively, and spring-loaded means operative normally to prevent accidental disconnection of said tongue and groove connection.

* * * * *